US009706802B2

(12) United States Patent
Bae

(10) Patent No.: US 9,706,802 B2
(45) Date of Patent: Jul. 18, 2017

(54) SPORTS BAND

(76) Inventor: Sanghyuk Bae, Seoul (KR)

( * ) Notice: Subject to any disclaimer, the term of this patent is extended or adjusted under 35 U.S.C. 154(b) by 217 days.

(21) Appl. No.: 14/347,632

(22) PCT Filed: May 7, 2012

(86) PCT No.: PCT/KR2012/003562

§ 371 (c)(1),
(2), (4) Date: Mar. 26, 2014

(87) PCT Pub. No.: WO2013/047970

PCT Pub. Date: Apr. 4, 2013

(65) Prior Publication Data

US 2014/0245520 A1 Sep. 4, 2014

(30) Foreign Application Priority Data

Sep. 30, 2011 (KR) ..... 10-2011-0099598

(51) Int. Cl.

| | |
|---|---|
| ***A41D 20/00*** | (2006.01) |
| ***G09F 21/02*** | (2006.01) |
| ***G09F 3/00*** | (2006.01) |
| ***A44C 5/12*** | (2006.01) |

(52) U.S. Cl.

CPC ..... *A41D 20/00* (2013.01); *A44C 5/12* (2013.01); *G09F 3/005* (2013.01); *G09F 21/026* (2013.01)

(58) Field of Classification Search

CPC ..... A41D 20/00; A41D 20/005; A61N 2/06; A44C 5/007; A44C 5/0023; A44C 5/0061; A44C 5/0092; A44C 5/12; G09F 21/026; G09F 3/005

USPC ..... 2/162, 170; 63/11, 33, 34; 604/289; 600/9, 15

See application file for complete search history.

(56) References Cited

U.S. PATENT DOCUMENTS

| | | | | |
|---|---|---|---|---|
| 4,087,989 | A * | 5/1978 | Taran | A44C 5/0084 63/11 |
| 5,081,852 | A * | 1/1992 | Cox | A44C 5/0084 63/3 |
| D402,911 | S | 12/1998 | Barcon | |
| D487,708 | S | 3/2004 | Strle | |
| D557,164 | S | 12/2007 | Cerullo et al. | |
| 8,225,626 | B1 * | 7/2012 | Blau | 63/11 |
| 2002/0095714 | A1 * | 7/2002 | Vernon | 2/181 |
| 2003/0035917 | A1 * | 2/2003 | Hyman | B41M 1/30 428/67 |

(Continued)

FOREIGN PATENT DOCUMENTS

| | | |
|---|---|---|
| JP | U3122261 | 5/2006 |
| KR | 20199414666 | 7/1994 |

(Continued)

*Primary Examiner* — Khaled Annis

(57) ABSTRACT

Provided is a sports band including a main body formed with one side open to be worn on a body of a user and to have a curvature, and wherein an expression zone having a form indicating a sports game is formed at both ends of the open side, and an expression layer exhibiting the form indicating the sports game on an external side of the expression zone, and the sports band disclosed herein may be used for various sports games including soccer, allow a user to express enthusiasm as well as a sense of unity with a sports game, provide a desirable wearing sensation not only for everyday use but also for the sports game, and improve physical vitality by a magnetic field.

9 Claims, 3 Drawing Sheets

(56) References Cited

U.S. PATENT DOCUMENTS

| | | | | |
|---|---|---|---|---|
| 2009/0007597 | A1* | 1/2009 | Hanevold | A44C 5/0015 63/1.14 |
| 2011/0048069 | A1* | 3/2011 | Komatsu | 63/1.11 |

FOREIGN PATENT DOCUMENTS

| | | |
|---|---|---|
| KR | 200417394 | 5/2006 |
| KR | 200431920 | 11/2006 |

* cited by examiner

【FIG. 1】
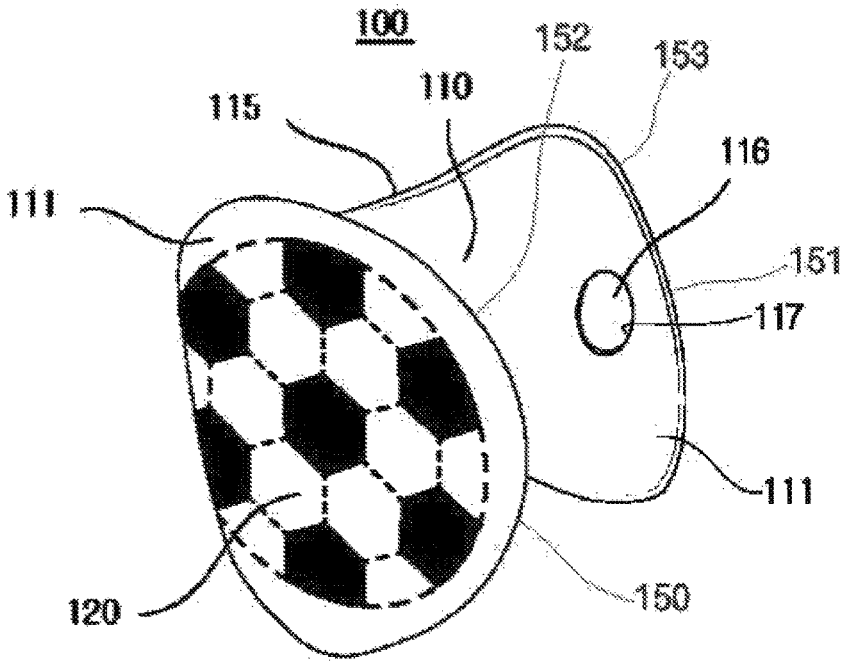

【FIG. 2】
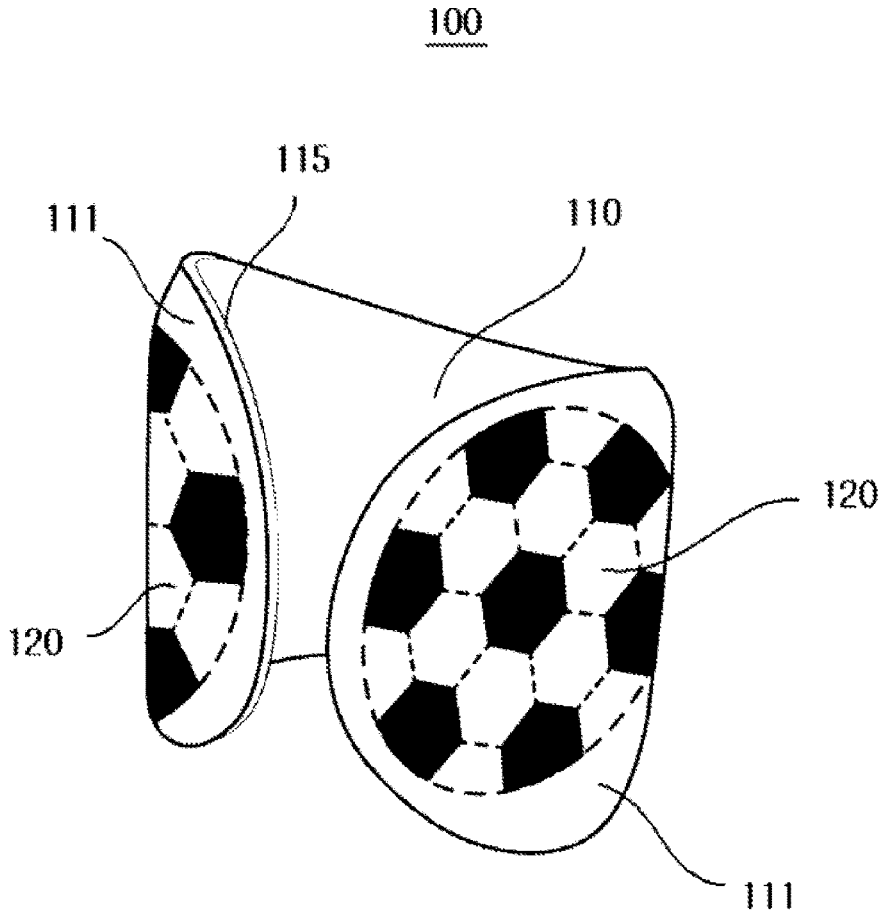

[FIG. 3]
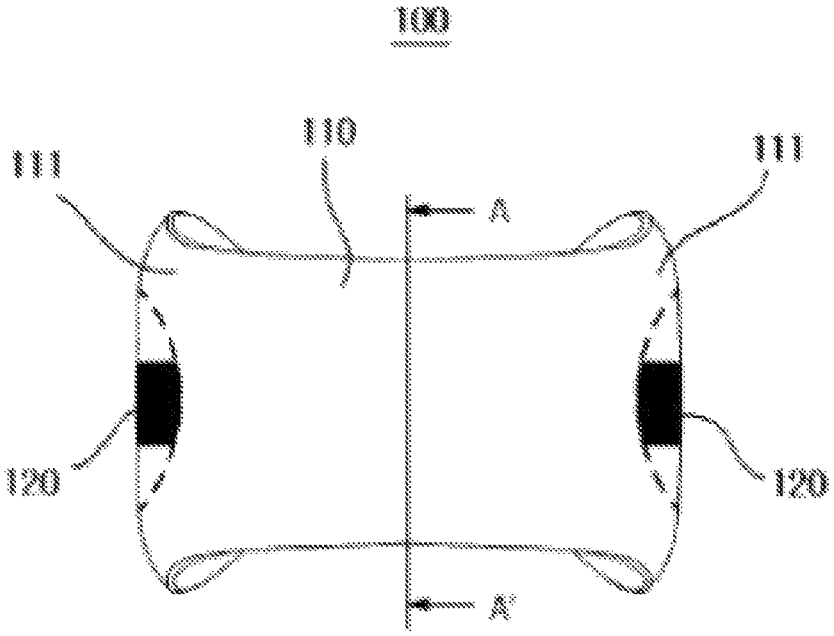
[FIG. 4]
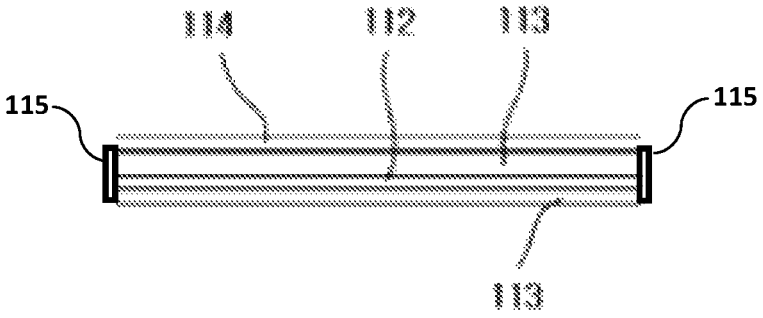

SPORTS BAND

TECHNICAL FIELD

The present invention relates to a sports band, and more particularly, to a sports band that may be used in various sports including soccer and with which a user may express enthusiasm as well as a sense of unity with the sports and may provide a desirable wearing sensation not only for everyday use but also for a sports game.

BACKGROUND ART

Generally, accessories have been used to add ornament effect to a wearer as well as to express personality of the wearer.

One of the accessories is a bracelet to be worn around a wrist. A conventional type of the bracelet may be provided mainly with metal or synthetic resin to be in a form of a ring designed to exhibit a fancy sense of beauty or configured to release a substance good for health.

However, the conventional type of the bracelet may be used exclusively to be worn around the wrist and have a limit to be used for sports. Especially, in order to express the enthusiasm for various kinds of sports as well as the sense of unity with the sports, there has been a need to develop a desirable product that may provide a desirable wearing sensation not only for everyday use but also for a sports game.

Meanwhile, the need described in the foregoing may also be applied to various kinds of accessories for a forearm and an ankle in addition to a wrist.

DISCLOSURE OF INVENTION

Technical Goals

In order to solve the issues described above, a purpose of present invention may provide a sports band that may be used in various sports including soccer, allow a user to express enthusiasm as well as a sense of unity with the sports, and provide a desirable wearing sensation not only for everyday use but also for a sports game.

Other purposes of the present invention may be easily understood from exemplary embodiments provided hereinafter.

Technical Solutions

According to an aspect of the present invention, there is provided a sports band including a main body with one side open to be worn on a body of a user and to be formed to have a curvature and with an expression area having a form corresponding to a form indicating a sports game formed at both ends of the open side thereon, and an expression layer in which the form indicating the sports game is formed on an external side of the expression area.

The main body may include a metal layer composed of a metal material, a contact layer adhered to an internal side and an external side of the metal layer and capable of being in contact with the body of the user, a protection layer formed on an external side of the contact layer for protection, and an adhesive layer formed at edges of the metal layer and the contact layer to improve adhesiveness between the metal layer and the contact layer and to prevent a formation of a gap.

The contact layer may be composed of one of or a combination of natural leather, artificial leather, polyurethane, rubber and fiber.

The expression layer may indicate the sports game on the natural leather, the artificial leather, the polyurethane, the rubber, or the fiber using one method of embroidery, print, embossment, and intaglio.

The form indicating the sports game of the expression layer may be a portion or a whole of a soccer ball.

The main body may be provided such that magnets disposed in the internal side at the both ends may be provided to face one another to allow a magnetic field to reach the body of the user.

Advantageous Effects of Invention

According to exemplary embodiments of the present invention, a sports band may be used for various sports games including soccer, may allow a user to express enthusiasm as well as a sense of unity with a sports game, provide a desirable wearing sensation not only for everyday use but also for the sports game, and improve physical vitality by a magnetic field.

BRIEF DESCRIPTION OF DRAWINGS

FIG. 1 is a perspective view of a sports band according to an embodiment of the present invention.

FIG. 2 is another perspective view of a sports band according an embodiment of the invention.

FIG. 3 is a side view of a sports band according to an embodiment of the present invention.

FIG. 4 is a cross-sectional view of a sports band cut based on an A-A' line of FIG. 3 according to an embodiment of the present invention.

DETAILED DESCRIPTION OF THE PREFERRED EMBODIMENTS

Since a variety of modifications may be made to the present invention and there are various embodiments of the present invention, examples of which will now be provided with reference to drawings and described in detail. However, the present invention is not limited thereto, although the exemplary embodiments can be construed as including all modifications, equivalents, or substitutes in a technical concept and a technical scope of the present invention.

Hereinafter, detailed descriptions of embodiments of the present invention will be provided with reference to drawings attached, wherein like reference numbers refer to the like elements throughout. A repeated description will be omitted for brevity.

FIG. 1 is a perspective view of a sports band according to an embodiment of the present invention. FIG. 2 is another perspective view of a sports band according to an embodiment of the present invention.

As illustrated in FIGS. 1 and 2, the sports band 100 may include a main body 110 having a first end 150 and a second end 151 to be worn on a user and an expression layer 120 disposed on the main body 110.

The main body 110 may be formed with one side open to be worn on a body of the user, for example, a wrist, a forearm, an ankle, and a thigh and to have a curvature. An expression zone 111 may be formed at both ends of the open side of the main body 110 and have a formed indicating a sports game of various sports games. In case the form indicating the sports game of the expression zone 111 is a ball, the form may be a circle surrounding the ball. Alternatively, the form may be various to express forms signifying various sports games.

The form indicating the sports game may be formed on an external side of the expression zone 111 of an expression layer 120, and be formed on natural leather, artificial leather, polyurethane, rubber, or fiber and attached to the expression zone 111 using one method of embroidery, print, embossment, and intaglio.

Also, the form indicating the sports game of the expression layer 120 may be a portion or a whole of a soccer ball. As another example, the form indicating the sports game may be a portion or a whole of a baseball, a basket ball, or a volleyball.

As illustrated in FIGS. 1, 3 and 4, a main body 110 may include a metal layer 112 composed of a metal material, a first and second contact layers 113 adhered to an internal and an external side of the metal layer 112 and capable of being in contact with a body of a user having a first edge 152 and a second edge 153 extending from the first end 150 to the second end 151 of the main body, a protection layer 114 formed on the external side of the contact layer 113 and disposed outside of the contact layer 113 to protect the contact layer 113, and an adhesive layer 115 formed at edges of the metal layer 112 and the contact layer 113 to improve adhesiveness between the metal layer 112 and the contact layer 113 and to prevent formation of a gap between the metal layer 112 and the contact layer 113.

The metal layer 112 may be provided with the metal material, for example, iron, copper, aluminum and titanium, and with a metal alloy, for example, bronze, brass, and alloyed steel, and be formed to have a modified form, although being capable of being restored.

The contact layer 113 may be attached to the metal layer 112 using an adhesive, and may be formed with one or a combination of natural leather, artificial leather, polyurethane, rubber and fiber. The fiber may include velvet or superfine fiber.

The protection layer 114 may be made of a liquid resin, for example, transparent or translucent polyethylene as a coating agent, which may be formed either prior to the formation of the contact layer 113 to prevent surface contamination or after the formation of the contact layer 113 to prevent damage to a sign, or may be formed on the external side of the expression layer 120 by coating.

In the main body 110, magnets 116 may be provided inside of both ends so that a magnetic field may be applied to the body of the user. Alternatively, the magnets 116 may be disposed to be exposed to installation grooves 117 respectively formed at the both ends, or be embedded to block an entrance of the installation grooves 117 with a cap.

An effect of a sports band according to the invention will be described hereinafter.

The sports band 100 according to the invention may be used for a sports game, for example, soccer, which may be indicated in the expression layer 120 and thereby, a user may express enthusiasm for the sports game and a sense of unity with the sports game.

Also, the sports band 100 may enable a form maintaining function using the metal layer 112, a desirable wearing comfort for everyday use or for the sports game using the contact layer 113, a desirable durability using the protection layer 114 and the adhesive layer 115, and an enhanced vitality of the body due to the magnetic field induced by the magnets 116.

Although exemplary embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

| [Reference Numerals] | |
|---|---|
| 110: Main body | 111: Expression zone |
| 112: Metal layer | 113: Contact layer |
| 114: Protection layer | 115: Adhesive layer |
| 116: Magnets | 117: Installation grooves |
| 120: Expression layer | |

The invention claimed is:

1. A sports band adapted to be worn on a body of a user, the sports band comprising:

a main body having a first end and a second end opposite the first end, wherein the main body has a curvature between the first end and the second end, and wherein the main body comprises:

a metal layer having an internal side and an external side opposite the internal side, the internal side and the external side each having a first edge and a second edge opposite the first edge, wherein the first edge of the metal layer and the second edge of the metal layer face each other;

a contact layer comprising a first contact layer attached to the internal side of the metal layer and a second contact layer attached to the external side of the metal layer, wherein the first contact layer and the second contact layer each having a first edge adjacent the main body first end and a second edge adjacent the main body second end opposite the first edge, wherein the metal layer is interposed between the first contact layer and the second contact layer, wherein the first contact layer is extended from the first edge of the internal side of the metal layer to the second edge of the internal side of the metal layer, wherein the second contact layer is extended from the first edge of the external side of the metal layer to the second edge of the external side of the metal layer, wherein the contact layer defines a portion of an exterior surface of the main body;

a protection layer formed on an external side of the second contact layer for protection; and an adhesive layer formed at the first and second edges of the metal layer and at the first and second edges of each of the first contact layer and the second contact layer to increase adhesiveness between the metal layer and the contact layer and to prevent formation of a gap; and an expression layer having an expression zone for exhibiting a form indicating a sports game.

2. The sports band of claim 1, wherein the contact layer is composed of at least one selected from the group consisting of natural leather, artificial leather, polyurethane, rubber, and fiber.

3. The sports band of claim 1, wherein the form indicating the sports game of the expression layer is formed on one selected from the group consisting of natural leather, artificial leather, polyurethane, rubber, and fiber, and is formed using one selected from the group consisting of embroidery, print, embossment, and intaglio.

4. The sports band of claim 3, wherein the form indicating the sports game of the expression layer is a portion or a whole of a soccer ball.

5. The sports band of claim 1, wherein the main body further comprises:

magnets facing each other in an internal side of the main body and disposed at the first and second ends to allow a magnetic field to reach the body of the user.

6. The sports band of claim 1, wherein the main body further comprises:

magnets facing each other in an internal side of the main body and disposed at the first and second ends to allow a magnetic field to reach the body of the user.

7. The sports band of claim 1, wherein the adhesive layer is in direct contact with the first and second edges of the metal layer, and wherein the adhesive layer is further in direct contact with the first and second edges of each of the first contact layer and the second contact layer.

8. The sports band of claim 1, wherein the second contact layer is interposed between the protection layer and the metal layer, wherein the protection layer is in direct contact with the second contact layer, and wherein the protect layer is extended from the first end of the external side of the metal layer to the second end of the external side of the metal layer.

9. A sports band adapted to be worn on a body of a user, the sports band comprising:

a main body having a first end and a second end opposite the first end, wherein the main body has a curvature between the first end and the second end, and wherein the main body comprises:

a metal layer;

a contact layer adhered to metal layer, the contact layer having a first contact layer and a second contact layer and the metal layer being interposed between the first contact layer and the second contact layer, wherein the first contact layer is extended from a first edge of an internal side of the metal layer adjacent the main body first end to a second edge adjacent the main body second end of the internal side of the metal layer, wherein the first edge of the metal layer and the second edge of the metal layer face each other, wherein the second contact layer is extended from a first end of an external side of the metal layer to a second end of the external side of the metal layer, wherein the first end of the internal side of the metal layer and the first end of the external side of the metal layer corresponds to the first end of the main body, and wherein the second end of the internal side of the metal layer and the second end of the external side of the metal layer corresponds to the second end of the main body;

a protection layer formed on an external side of the contact layer disposed outside of the contact layer for protection; and an adhesive layer formed at edges of the metal layer and the contact layer to improve adhesiveness between the metal layer and the contact layer and to prevent formation of a gap, wherein the adhesive layer defines a portion of an exterior surface of the main body; and an expression layer having an expression zone displaying a form indicating a sports game.

* * * * *